United States Patent [19]

Hutchings et al.

[11] 3,965,733

[45] June 29, 1976

[54] CRANE LOAD INIDICATING ARRANGEMENT

[75] Inventors: Bernard David Francis Hutchings, Chelmsford; Robert William Hubbard, Southend-on-Sea, both of England

[73] Assignee: Pye Limited, Cambridge, England

[22] Filed: May 10, 1974

[21] Appl. No.: 468,764

[30] Foreign Application Priority Data

Mar. 15, 1973 United Kingdom ..... 22500/73

[52] U.S. Cl. ..... 73/133 R; 235/151.33; 340/267 C

[51] Int. Cl.[2] ..... B66C 13/16

[58] Field of Search ..... 212/39 MS, 39 R; 235/151.33; 340/267 C; 73/133 R

[56] References Cited

UNITED STATES PATENTS

| | | | |
|---|---|---|---|
| 3,586,841 | 6/1971 | Griffin | 235/151.33 |
| 3,870,160 | 3/1975 | Hutchings | 235/151.33 X |

*Primary Examiner*—Charles A. Ruehl
*Attorney, Agent, or Firm*—Frank R. Trifari; Bernard Franzblau

[57] ABSTRACT

A crane safe load indicator combines signals representing the total loaded boom turning moment and the turning moment of the boom alone to derive a third signal representing the turning moment of the load alone. The third signal is compared with a signal representing the crane's maximum safe load moment to indicate available lifting capacity.

20 Claims, 5 Drawing Figures

CRANE LOAD INIDICATING ARRANGEMENT

Figure 1:
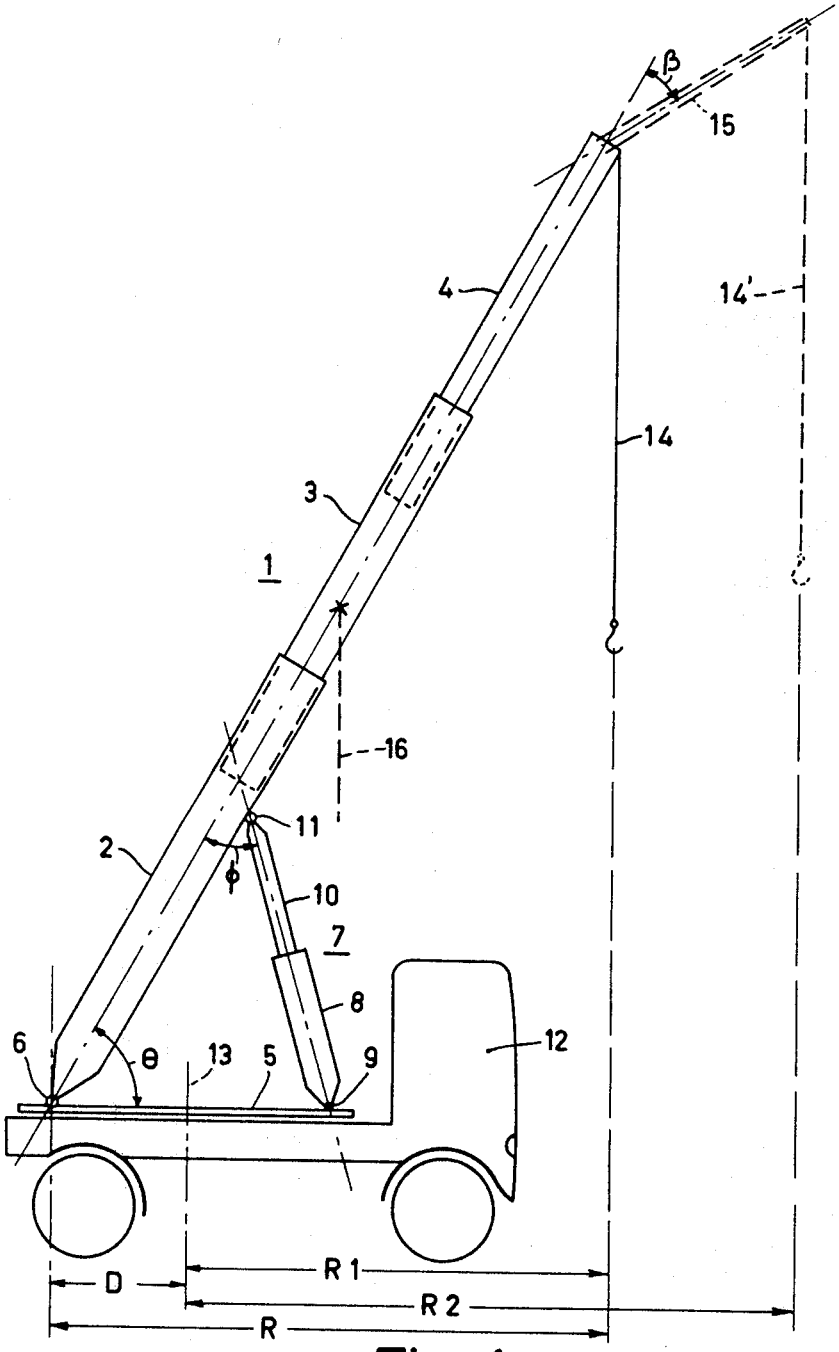

This invention relates to a load indicating arrangement for use with cranes, derricks, and other lifting apparatus of the type having a pivoted boom which can be luffed by an hydraulic ram or other boom supporting means. It has a particular but non-exclusive application to mobile cranes of the above type having an extensive boom which can be slewed through the whole or part of a circle.

A typical mobile crane of the above type has a boom comprising a plurality of telescoping sections, of which the lowermost is pivoted to a base unit for luffing movement by means of an hydraulic ram. One end of the ram is also pivoted to the base unit, and the other end is pivoted to a point on the lowermost boom section so as to support the boom at an angle (the luff angle) to the horizontal which is determined by the extension of the ram. The base unit is mounted on a road or rail chassis and is arranged to slew through the whole or part of a circle about a vertical axis. As an alternative to the hydraulic ram, the boom can be supported by a winch cable which is secured to its outer end and which can be wound in and out to luff the boom. For this alternative the boom is not usually telescopic.

The chassis may be provided with outriggers or blocking girders which are carried in a stowed position when the crane is in road trim, but which can be extended outwards from the chassis and have their outer ends blocked up from the ground in order to increase the crane's stability and to relieve the load on the road wheels.

For basic duties of the crane, a load is supported by a hoist rope or cable passing over a sheave at the outer end of the boom. The crane can lift loads located within a range of radii measured from its slewing center. For lifting light loads, a fly jib may be secured to the outer end of the boom. This increases the radius of action of the crane.

Such a crane has a number of possible modes of operation, for example, blocked, free on wheels, and with or without fly jib. In whatever mode the crane is operated, the load must be limited so that the overturning moment which it produces does not imperil the crane stability and also that no component part of the crane is over-stressed.

When operating without a fly jib, the prime consideration is stability. Stability is greatest when the outriggers are extended and blocked up. In the free on wheels condition, stability is frequently greater when the boom is extended over an end of the chassis than when it is slewed to one side or the other because the wheel base length of the chassis is usually substantially greater than its track width.

A fly jib is usually of much lighter construction than the main boom to which it is secured and is adapted to support only relatively light loads. Over much of the radius of operation of the crane, the strength of the fly jib is the limiting factor in determining the maximum safe load and the question of stability does not arise. At large radii, however, when the main boom is fully extended and at a small luff angle, the moment produced by a load which is within the strength capability of the fly jib may reach the stability limit.

The crane manufacturer prepares rating tables which give the maximum permissible loads which the crane may lift. A separate table is prepared for each possible mode of operation. In general, for modes of operation involving basic duties, the safe load is related to the radius from the slewing center (i.e. radius related duties). For duties involving the fly jib, the safe load may be related to luff angle below a given value of radius (i.e. angle related duties) and to radii above that value, or may be related to luff angle for all radii.

According to the present invention a load indicating arrangement for use with a crane or other lifting apparatus of the type specified comprises, means for producing a first output representative of the total turning moment of the boom about its pivot in supporting a load, means for producing a second output representative of the turning moment of the boom about its pivot due to the weight of the boom alone, means for producing a third output which is the algebraic difference between said first and second outputs and is thus representative of the turning moment due only to the load, a law generator unit in respect of each mode of operation of the crane involving radius related duties, each unit being adapted to produce a fourth output representative of the maximum safe load moment for the crane in the appertaining mode of operation for the load radius currently obtaining, and means for comparing said fourth output with said third output to provide an indication of available lifting capacity.

Also according to the present invention such arrangement further can comprise a law generator unit in respect of each mode of operation of the crane involving angle related duties, each of these latter units being adapted to produce said fourth output which in this case is representative of the maximum safe hook load for the crane in the appertaining mode of operation and for the luff angle currently obtaining, together with means for producing a fifth output which is representative fo the weight of the load and means for comparing said fifth output with said fourth output to provide an indication of the actual crane hook load relative to the maximum safe hook load.

In the above context, the term "weight of the boom alone" is meant to embrace the weight of the boom with or without a fly jib, together with the weight of the sheave, hoist rope, hook, etc., that is, the total weight of the structure that supports the load, but excluding the weight of the load.

In carrying out the invention said first output is preferably determined in terms of the angle included between the boom supporting means and the boom, and of the reaction sustained by the boom supporting means in supporting the boom and any load suspended from it. More specifically, transducer means can be provided for producing an output which is a function of said reaction, together with angle sensing means for modifying said output in accordance with the sine of the angle included between the boom supporting means and the boom to produce said first output.

The word "reaction" is used herein to signify the force to which the boom supporting means is subjected in supporting the boom (and load). If the boom supporting means is a hydraulic ram then the force would be a function of the fluid pressure in the ram, whereas if the boom supporting means is a winch cable then the force would be a function of the stress to which the cable is subjected. The reaction sustained by the boom supporting means can thus readily be determined as an electrical signal by a pressure transducer or a resistance strain gauge transducer which is appropriately mounted to suit the design of the crane.

In order that said second output represents accurately the turning moment of the boom about its pivot due to the weight of the boom alone, the arrangement preferably includes means for determining this second output for either basic duties or fly jib duties of the crane, because both the total weight and the total length of the boom will be greater with a fly jib than without it, so that the position of the center of gravity of the total structure and thus the boom turning moment will be different for these two duties for a given boom extension and luff angle. The position of the center of gravity will also change with boom extension. The arrangement also preferably includes means for correcting for boom deflection (or bending) in the production of said second output to take into account the effective increase in the horizontal distance of the load from the boom pivot point due to boom deflection; that is, the effective increase in load radius.

For modes of operation involving basic duties, each law generator unit concerned is responsive to a (radius) output which is representative of the horizontal distance between the boom pivot point and the load, (i.e., radius related operation), whereas for modes of operation involving fly jib duties, each law generator unit concerned is responsive to an output from a boom angle sensing means (i.e. luff angle related operation).

Each law generator unit may be brought in to use selectively by means of mode sensors which are adapted to be activated selectively as the crane is set up for different modes of operation. Alternatively, plug-in law generator units can be provided for each mode of operation.

Means may also be provided to produce an output which is representative of actual hook load and can be utilized to operate a meter which is calibrated to show actual weight of the load. Other meters can be provided which are responsive to said radius output and the output from the boom angle sensing means to show load radius and luff angle, respectively.

Figures 2, 2A, 2B, 2C:
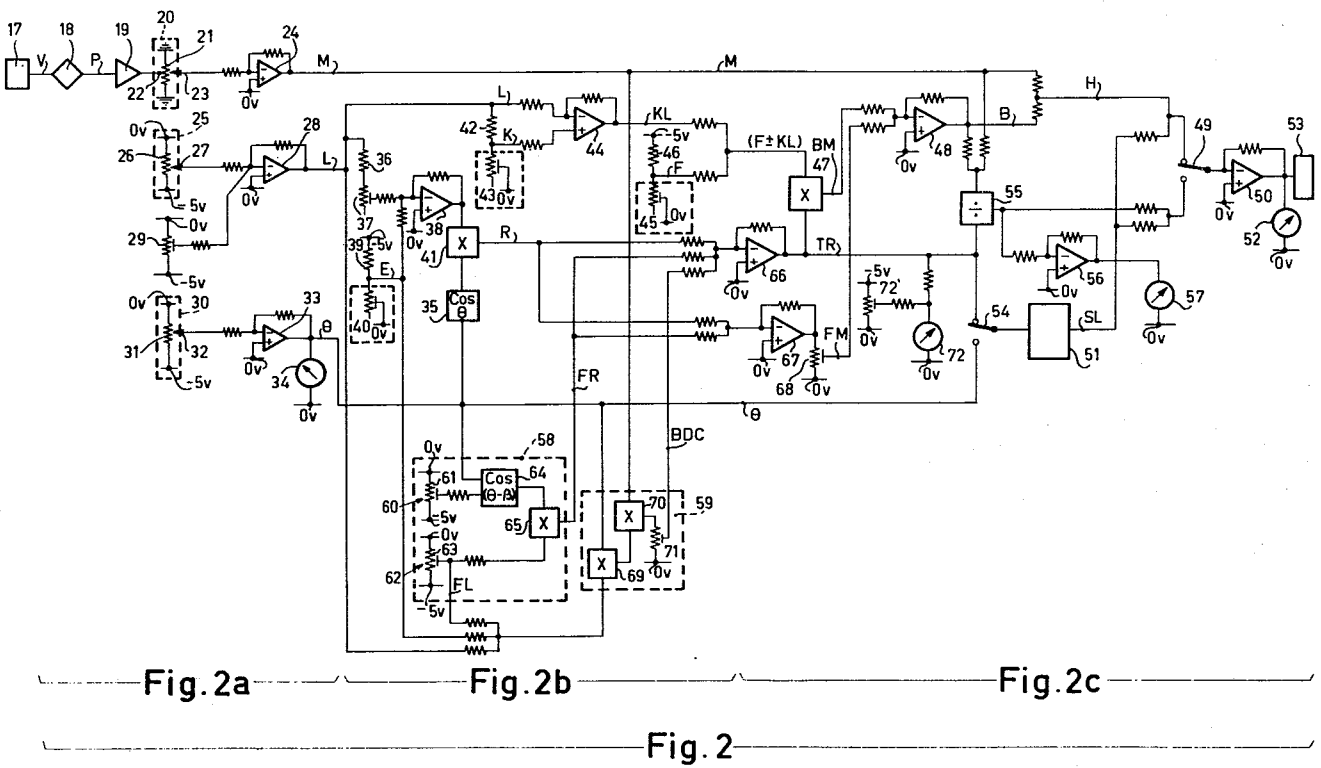
Figure 3:
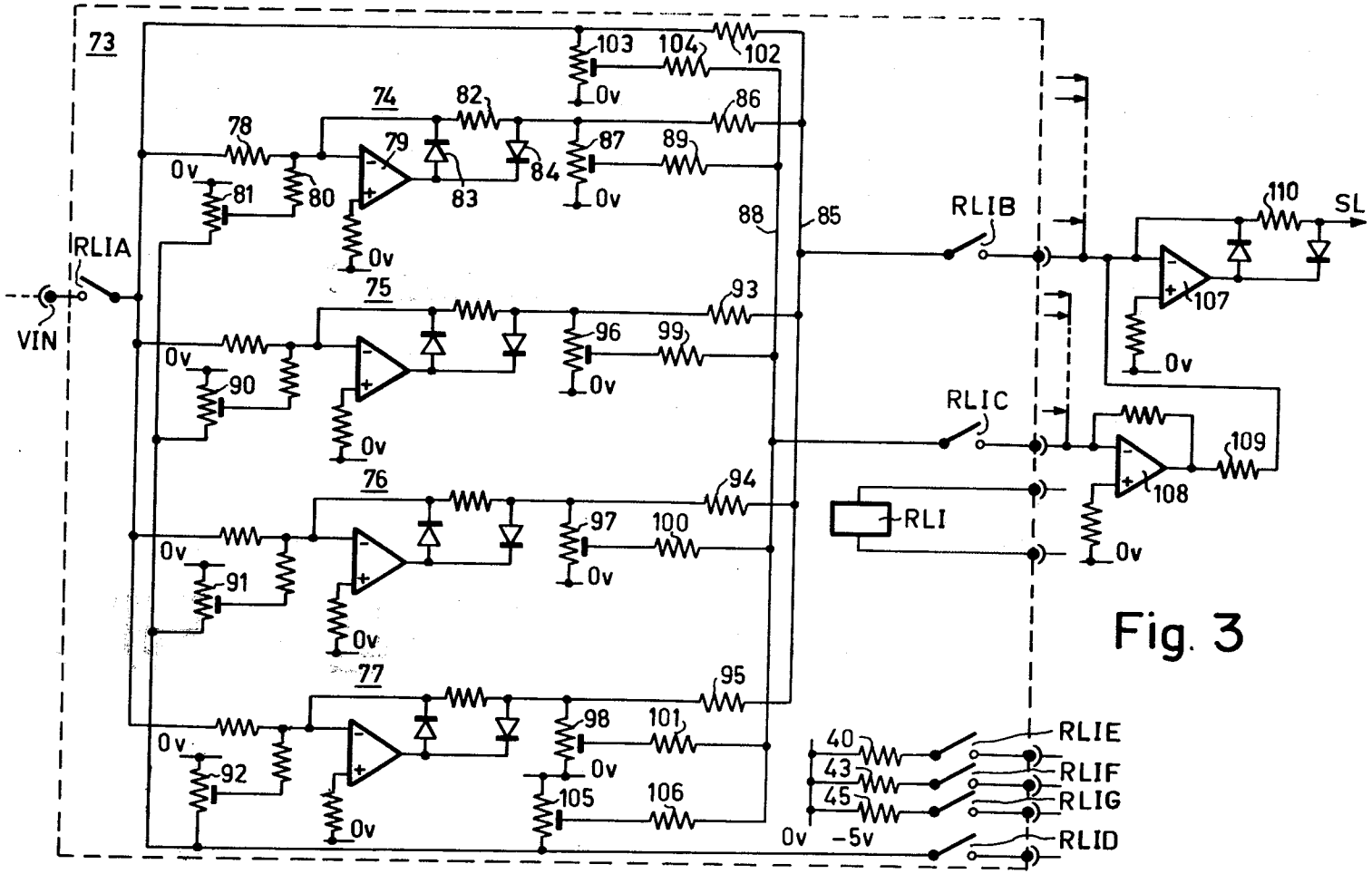

In order that the invention and the manner in which it is to be performed may be more fully understood, an embodiment thereof will now be described, by way of example, with reference to the accompanying drawings, in which:

FIG. 1 is a diagrammatic representation of a mobile crane,

FIG. 2 (which comprises FIGS. 2*a*, 2*b* and 2*c* laid side-by-side in that order) is a block schematic diagram of a load indicating arrangement according to the invention; and FIG. 3 is a schematic diagram of a law generator unit for use in the arrangement of FIG. 2.

Referring first to FIG. 1, the mobile crane there shown has a boom, indicated generally by the reference numeral 1, which comprises a lower section 2, an intermediate section 3 slidable telescopically within the upper end of the seection 2, and an upper section 4 slidable telescopically within the upper end of the section 3. Extension means such as an hydraulic ram (not shown in FIG. 1) is provided to position the section 3 with respect to the section 2 and to position the section 4 with respect to the section 3, so that the overall length of the boom 1 may be adjusted to any desired value between a maximum and a minimum limit.

The lower end of the boom section 2 is pivoted to a horizontal base unit 5 at a point 6 so as to permit luffing movement of the boom 1. An hydraulic luffing ram 7 has one end of its cylinder 8 pivoted to the base unit 5 at a point 9 and its piston rod 10, which extends through the other end of the cylinder 8, pivoted to the boom section 2 at a point 11. The axis of the boom 1 makes an angle $\theta$ (the luff angle) with the horizontal, $\theta$ being variable by varying the extension of the luffing ram 7.

The base unit 5 is mounted upon a road vehicle chassis 12 and is arranged for rotation with respect to the chassis about a vertical axis on a slewing center 13.

For basic duties of the crane, a load is suspended by a hoist rope 14 which passes over a sheave (not shown) at the outer end of the boom section 4 to a winding drum (also not shown). It will be seen that by varying the extension of the boom and/or the luff angle the horizontal distance R1 between the slewing center 13 and the hoist rope 14 can be varied so as to lift loads located within a range of radii from the slewing center.

For fly jib duties of the crane, a fly jib 15, shown in broken outline in FIG. 1, is secured to the outer end of the boom section 4, and the hoist rope 14′ passes over a sheave (not shown) at its outer end. For any combination of boom extension and luff angle, the horizontal distance R2 between the slewing center 13 and the hoist rope 14 is greater than the corresponding value of R1.

A load suspended by the hoist rope 14 (14′) exerts a turning moment about the boom pivot point 6. To this is added the turning moment exerted by the weight of the boom acting through its center of gravity 16. The total turning moment is opposed by the reaction component normal to the boom axis of the luffing ram 7.

A load indicating arrangement for a mobile crane of the above type will now be described with reference to FIGS. 2 and 3. The arrangement will be described firstly in relation to basic duties of the crane and additional features required in respect of fly jib duties will follow.

Referring to FIG. 2, a reference signal generator 17, for example a 700 Hz square wave oscillator, provides a stable signal V of constant voltage. This signal V is supplied to a transducer 18 which is connected to the luffing ram 7 (FIG. 1) and is adapted to produce an output P which is a function of the reaction sustained by the ram in supporting the boom 1 and any load suspended from it. When the ram 7 is of the single-acting type, the output of the transducer 18 is a function of (e.g. proportional to) hydraulic fluid pressure below the ram piston 10. For a double-acting ram the transducer output is a function of (e.g. proportional to) the difference between the pressures below and above the ram piston 10, modified by the ratio of the effective areas of the lower and upper sides of the piston. For a double-acting ram, two transducers are usually mounted to measure pressures above and below the ram piston, and their outputs are combined electrically to produce a resultant transducer output.

The signal P is applied via a buffer amplifier 19 to an input terminal of a ram angle sensor 20, comprising a potentiometer having a resistive track 21. The ends of the track 21 are connected to ground and the signal P is applied at a tapping point 22 intermediate the ends of the track 21. The potentiometer body is mounted in fixed relation to the boom 1 and a slider 23, which contacts the track 21, is mechanically coupled to the luffing ram 7 so that it moves over the track 21 when the angle $\phi$ included between the boom 1 and the ram 7 changes with changing extension of the ram. The track 21 is graded so that the signal appearing at the slider 23 is proportional to sin $\phi$. The slider 23 is connected to an input terminal of an amplifier 24 which provides an amplified output M proportional to P sin $\phi$, i.e. to the component of the ram reaction normal to the boom 1. Output M is therefore also proportional to the total moment of the boom about the boom pivot point 6.

A boom extension sensor 25 comprises a potentiometer having a resistive track 26 and a slider 27 which is mechanically coupled to the boom so as to be driven over the track 26 as the boom extension is varied from minimum to maximum. The end of the track 26 corresponding to maximum extension is connected to the negative terminal of a stabilized reference supply (e.g. −5V), the other end being connected to the Ov side of the supply. It is assumed for the purposes of the present description that the load indicating arrangement is energized by a −5V stabilized reference supply, but it is to be understood that this voltage is given only as an example and that the actual voltage supply required depends upon the type of circuit elements used in the load indicating arrangement. The slider 27 is connected to an input terminal of a buffer amplifier 28. Also connected to this input terminal of amplifier 28 is a preset potentiometer 29 connected across the −5v reference supply. This potentiometer 29 is provided to facilitate initial setting-up of the arrangement. The amplifier 28 produces an output L proportional to the boom extension.

A boom angle sensor 30 comprises a potentiometer mounted for movement with the boom 1 and having a resistive track 31 connected across the −5v reference supply. A slider 32 is gravity actuated, e.g. by a pendulum, so that it moves over the track 31 as the luff angle $\theta$ changes when the extension of the luffing ram 7 is varied. The slider 32 is connected to an input terminal of a buffer amplifier 33 which gives an output $\theta$ proportional to the luff angle $\theta$. This output may be used to drive a meter 34, which is scaled in terms of luff angle, and this output is also applied to a cosine law generator unit 35 (FIG. 2*b*). This unit 35 is preferably of a type in which the slope of its input/output characteristic is modified stepwise in accordance with changes in its input amplitude so as to produce an overall characteristic comprising a plurality of linear sections of differing slopes and closely approximating to a cosine law. The resultant output from unit 35 is thus proportional to the cosine of the luff angle $\theta$.

The boom extension output L produced by the amplifier 28 is fed via a gain control element comprising a fixed resistor 36 and a preset variable resistor 37 to an input terminal of a summing amplifier 38. Also fed to this input terminal is an output E, proportional to the length of the boom when fully retracted, which is obtained from a potential divider comprising a fixed resistor 39 and a preset variable resistor 40 connected in series across the −5v reference supply.

The fully-retracted length of the boom is constant for any one mode of operation of the crane, but may vary from mode to mode, e.g. if a fly jib is used. As will be described more fully later, a plurality of resistors such as resistor 40 is provided, each one preset to the value appropriate to a particular mode, and means represented by the dotted rectangle including resistor 40 are provided for selecting the particular resistor corresponding to each mode of operation.

The resultant output of the amplifier 38 is thus proportional to the total length of the boom and is applied as a first input to an analogue multiplying unit 41. The output of the cosine law generator unit 35 is applied as a second input to the unit 41. Thus, the unit 41 produces a resultant output R proportional to (L + E) cos $\theta$. It can be seen from FIG. 1 that (L − E) cos $\theta$ is the basic horizontal distance between the boom pivot point 6 and the load and that it equals the sum of the radius R1 of the load from the slewing center 13 and the distance D between the slewing center and the boom pivot point. By basic horizontal distance is meant that no account has been taken in the derivation of the output R of the radius increase when the fly jib is fitted and the radius increase due to boom deflection. Thus, output R $\alpha$ basic radius.

A circuit element 58 produces an output FR representing the radius increase due to a fly jib, when fitted, and a circuit element 59 produces an output BDC representing the radius increase due to boom deflection. Detailed descriptions of these circuit elements 58 and 59 are given hereinafter. The outputs R, FR and BDC are summed by an amplifier 66 (FIG. 2*c*) to produce an output TR proportional to the true radius of the load from the boom pivot point 6.

The turning moment of the boom alone (i.e. neglecting the moment of the load) about its pivot point 6 is determined by the (constant) weight of the boom acting through its center of gravity 16, and by the position of the center of gravity. The latter will change as the boom extension is varied, and the change will be affected by the telescopic structure of the boom. It is apparent that a weight can be computed which varies as a function of boom extension and which when assumed to act at the outer end of the boom can produce the same turning moment as that produced by the weight of the boom structure acting through its center of gravity; that is, a weight which is representative of the weight of the boom structure acting through its center of gravity. It can be shown that an expression for such a weight has the form (F ± KL), where F is a constant related to the weight of the boom structure, and KL is related to the position of the center of gravity of the boom structure, for a given mode of operation, K being a constant for a particular boom and L being the boom extension.

A potential divider comprising a fixed resistor 42 and a preset variable resistor 43 in series is connected between the output terminal of the amplifier 28 and the OV line. The value of the resistor 43 is set to produce an output proportional to K at the tapping point of the potential divider. Since the value of K may vary from mode to mode of operation of the crane, a plurality of resistors such as resistor 43, each one preset to the value appropriate to a particular mode, is provided together with means (to be described hereinafter) represented by the dotted rectangle including resistor 43 for selecting the particular resistor corresponding to each mode of operation. The outputs L and K are applied to respective input terminals of an amplifier 44 which produces an output KL.

A further potential divider comprising a preset variable resistor 45 and a fixed resistor 46 in series is connected across the −5v reference supply, the value of the resistor 45 being set so as to produce an output proportional to the constant F at the tapping point of the potential divider. In this case too a plurality of preset resistors such as resistor 45 is provided for each mode of operation, together with means represented by the dotted rectangle including the resistor 45 for selecting the particular resistor corresponding to each mode. The outputs KL and F are fed via respective summing resistors as one input to an analogue multiplying unit 47. The output TR is fed as a second input to the unit 47, whose output is therefore equal to (F ± KL)TR, that is, the output BM is thus proportional to the turning moment of the boom.

This output BM from unit 47 is applied to an input terminal of a summing amplifier 48. To this input terminal are also applied, as will be described, a further output FM, which represents the moment due to a fly jib, when fitted. The resultant output B from the summing amplifier 48 may thus be termed true boom moment, since it is proportional to the turning moment due to the boom, as corrected having regard to the fly jib (when present) and any boom deflection. The output B is of opposite polarity to the output M, which as previously stated, is proportional to the total moment of the boom and the load. These two outputs are summed to produce a resultant output H = (M—B) proportional to the turning moment due to the load alone. The output H is applied via relay changeover contact 49 to an input terminal of a summing amplifier 50.

A further output SL is produced by a mode unit 51, which will be described presently, and is also applied to the input terminal of the amplifier 50. This output SL is proportional to the maximum safe load moment which the crane is permitted to withstand during radius-related duties for the boom length and luff angle that currently obtain in any particular mode of operation. The unit 51 produces the output SL in response to the true radius output TR. The output SL is arranged to have a polarity opposite to that of the output H so that the net input to the amplifier 50 is equal to (SL—H). When, therefore, the crane has reached its maximum safe load moment in a particular mode of operation, SL = H and the net input is zero. The output of amplifier 50 is consequently also zero and is indicated at the calibration point of a safe working load meter 52 connected to the output terminal of the amplifier 50, the meter zero having been offset mechanically to this calibration point. Increase of load moment above the rated maximum (H > SL) will produce a net input of one polarity and a corresponding output from the amplifier 50 which will drive the meter 52 into an overload region of its scale. Load moments less than the rated maximum (SL > H) will produce a net input and a corresponding output from the amplifier 50 of the opposite polarity, driving the meter 52 into a safe region of its scale and so indicating available lifting capacity.

The output of the amplifier 50 may also be applied to an alarm unit 53 which is adapted to produce an audible and/or visual alarm signal when the maximum safe load moment is reached or exceeded. The alarm unit 53 may also include means to provide a preliminary warning signal when the load moment exceeds a predetermined percentage of the maximum safe load moment and/or trip circuits to cut off power to the hoist motor in the event of an overload.

For modes of operation of the crane involving basic (radius-related) duties, or fly jib duties at very large radii, the load moment is sufficiently greater than the true boom moment for the comparison of load moment with maximum safe load moment to give a good dynamic range of operation of the arrangement, that is, an accurate indication of available lifting capacity for a wide range of load. However, for fly jib (angle-related) duties at lesser radii for which the maximum safe load is determined by the strength of the fly jib, the true boom moment can constitute a very high percentage of the total turning moment, so that only a poor dynamic range of operation would be possible because the range of values available for signifying the load moment output would be small. Therefore, for angle-related duties of the crane, the mode unit 51 concerned is connected to receive the output from the boom angle sensor 30 by operation of a relay changeover contact 54 and changeover contact 49 is operated to connect to the input terminal of amplifier 50 the output SL from the mode unit 51 and the output from an analogue divider unit 55. This unit 55 has as inputs the true radius output TR referred to earlier and another output H = (M—B) proportional to the turning moment due to the load alone. The unit 55 is responsive to these two inputs to produce an output HL proportional to the weight of the load. The output SL, as now produced by the relevant unit 51, is combined algebraically with the output HL so that the net input to the amplifier 50 is now equal to (SL ± HL). In other words, the indication by the meter 52 of available lifting capacity, and the operation of the alarm unit 53, are now given in respect of actual hook load, as compared with load moment, which was the case for radius related duties. The output HL is also applied to an input terminal of an amplifier 56 the output of which drives a meter 57 which is calibrated to indicate actual hook load. This meter 57 provides such an indication for both radius related duties and angle related duties of the crane.

Considering now the circuit element 58 which provides corrective outputs when a fly jib is fitted, and the circuit element 59 which provides corrective outputs in respect of boom deflection. It is these corrective outputs which contribute to the production of the true radius output TR and the output B proportional to true boom moment. More specifically the circuit element 58 comprises a first potentiometer 60 having a resistive track 61 connected across the —5v reference supply. This potentiometer 60 is preset so as to provide an output proportional to the fly offset angle $\beta$. A second potentiometer 62 having a resistive track 63 connected across the —5v reference supply is preset so as to provide an output FL proportional to the length of the fly jib. The output from the potentiometer 60 is applied together with the output $\theta$ from amplifier 33, which is proportional to the luff angle $\theta$, to a cosine law generator unit 64 that can be of a type similar to the cosine law generator unit 35 but is arranged to give an output proportional to cos ($\theta$—$\beta$). This output from the unit 64 is applied as one input to an analogue multiplying unit 65. The output FL from the potentiometer 62 is applied as a second input to the unit 65 which is responsive to these two inputs to produce the output FR which is proportional to the "fly radius", that is the distance R2—R1 in FIG. 1. This output FR is applied to an input terminal of the summing amplifier 66 as previously described, and also to an input terminal of a summing summin amplifier 67. The output R from unit 41, which is proportional to the basic radius, is applied to the same input terminal of amplifier 67, which sums these two inputs to produce an output proportional to the total distance R= (R2—R1). A potentiometer 68 is connected between the OV line and the output terminal of the amplifier 67. This potentiometer is preset in accordance with the weight of the fly jib acting through its center of gravity. Thus, the output FM at the slider of potentiometer 68 is proportional to the turning moment of the fly jib. This output FM is summed with the output from unit 47 in the amplifier 48.

The circuit element 59 comprises two analogue multiplying units 69 and 70. The outputs L, E and FL are summed to form one input to the unit 69 and the output $\theta$ is applied to the unit 69 as a second input. The resultant output (L + E + FL) $\theta$ from the unit 69 is thus proportional to the product of the total length (including fly jib when fitted) of the boom and the luff angle $\theta$. This resultant output is applied as one input to the unit 70 and the output M, proportional to the total turning moment of the boom, is applied as a second input to this unit 70. A potentiometer 71 is connected between the OV line and the output terminal of the unit 70, this potentiometer being preset on initial setting-up of the arrangement to provide a resistance value appropriate to the particular boom structure concerned. The output from the unit 70 is the product of the output M and the output (L + E + FL) $\theta$ and is adjusted in magnitude by the setting of potentiometer 71 to form the output BDC which is a function of the boom deflection that occurs for the boom length, luff angle, and total turning moment currently obtaining. Boom deflection results in an increase in the load radius so that summation of the output BDC with the outputs R and FR at amplifier 66 produces the true radius output TR. A meter 72 is provided to indicate true radius of the load in response to the true radius output TR. Since this output represents the horizontal distance of the load from the pivot point 6, a potentiometer 72' connected across the −5v reference supply may be provided, as indicated, to "back-off" the meter 72 by an amount corresponding to the distance D (FIG. 1), so that the meter 72 then indicates the radius from the slewing center 13.

The mode unit 51, which will now be described with reference to FIG. 3, comprises a plurality of similar law generator units, each adapted to provide an output which varies according to a predetermined law. One law generator unit is provided for each separate mode of operation which the crane can perform, and is preset to a law corresponding to the manufacturer's rating curve for that mode of operation. Means are provided to select the Particular law generator unit corresponding to the mode of operation being performed.

Referring to FIG. 3, a law generator unit 73 is carried on a printed circuit board indicated by the broken line rectangle. The circuit of this unit comprises a plurality of similar threshold amplifiers indicated generally by the references 74, 75, 76 and 77. A positive input $V_{IN}$, which can be either the luff angle output $\theta$ from amplifier 33 or the true radius output TR from amplifier 66 (see FIG. 2), is applied to each threshold amplifier. Considering first the threshold amplifier 74, the input $V_{IN}$, which passes through a contact RLIA of a relay RL1 which is energized when the particular unit 73 is in use, is fed via an input resistor 78 to an input terminal of an amplifier 79. A negative bias signal is fed to the same input terminal via a resistor 80 from the slider of a preset potentiometer 81 (Break 1) connected between a −5V reference supply (via relay contact RLID) and ground. The output terminal of amplifier 79 is connected to the same input terminal thereof via a feedback circuit comprising a resistor 82 and two diodes 83 and 84. The arrangement is such that if the magnitude of the positive input $V_{IN}$ is less than the magnitude of the negative bias signal, giving a net negative input to the amplifier 79, the amplifier output tends to go positive. This causes the diode 83 to conduct. Since the input to the amplifier 79 is a virtual ground, the output is therefore clamped substantially at ground potential (plus the voltage developed across the low forward resistance of the diode 83) for all values of the input $V_{IN}$ less than the value of the bias voltage set by the potentiometer 81.

If the value of the input $V_{IN}$ is greater than the bias voltage value, thus giving a net positive input, the output of amplifier 79 goes negative. Diode 83 is cut off, but diode 84 conducts, connecting resistor 82 as a feedback resistor between the output and input terminals of the amplifier 79.

Therefore, as the input $V_{IN}$ varies from zero to its maximum, say −5V, the output of the threshold amplifier 74 remains substantially zero until the input $V_{IN}$ reaches a value (the threshold or break value) determined by the setting of the (Break 1) potentiometer 81. Thereafter, the output increases linearly with a further increase of the input $V_{IN}$, with a negative polarity and at a rate determined by the relative values of the feedback resistor 82 and the input resistor 78.

The output of the threshold amplifier 74 is applied to a first summing junction 85 via a resistor 86, and also to one end of a Slope 1 potentiometer 87. The slider of the potentiometer 87 is connected to a second summing junction 88 via a resistor 89.

The threshold amplifiers 75, 76 and 77 are similar to the amplifier 74 just described and are provided with respective threshold-setting potentiometers 90 (Break 2), 91 (Break 3) and 92 (Break 4). Their outputs are applied to the first summing junction 85 via respective resistors 93, 94 and 95; and also to respective potentiometers 96 (Slope 2), 97 (Slope 3) and 98 (Slope 4). The sliders of the potentiometers 96, 97 and 98 are connected via respective resistor 99, 100 and 101 to the second summing junction 88.

The input $V_{IN}$ is applied to the first summing junction 85 via a resistor 102 and also to an "Initial Slope" potentiometer 103, whose slider is connected to the second summing junction 88 via a resistor 104.

A "Shift" potentiometer 105 is connected between ground and the −5V reference supply, and its slider is connected to the second summing junction 88 via a resistor 106.

The first summing junction 85 is connected via relay contact RLIB to an input terminal of an amplifier 107 contained in the mode unit 51. The second summing junction 88 is connected via relay contact RLIC to an input terminal of an inverting amplifier 108, whose output terminal is connected, via a resistor 109 to the said input terminal of amplifier 107.

The operation is as follows: ignoring for the present the second summing junction 88 and the amplifier 108, the output of the amplifier 107 depends on the contributions to the first summing junction from the input $V_{IN}$ via resistor 102 and from the threshold amplifiers 74, 75, 76 and 77.

As the input $V_{IN}$ increases from zero, current flows through resistor 102, but until the input $V_{IN}$ reaches the respective break points of the threshold amplifiers, their outputs all remain zero. Consequently, the output of the amplifier 107 initially increases linearly with the input $V_{IN}$ at a rate determined by the relative values of a feedback resistor 110 and the resistor 102, and with a negative polarity.

When the input $V_{IN}$ reaches the first break point, determined by the getting of the potentiometer 81, the first threshold amplifier 74 commences to supply an output which increases linearly with further increase of the input $V_{IN}$, and which is negative going. The current flowing via resistor 86 into the input terminal of the amplifier 107 is therefore of opposite polarity to the current flowing via resistor 102. The net effect is that the rate of rise of input current with an increase of the input $V_{IN}$ is reduced for values of the input $V_{IN}$ above the first break point. Therefore, the rate of increase of the output of the amplifier 107 is similarly reduced.

As the input $V_{IN}$ continues to increase it reaches successively the second, third and fourth break points determined respectively by the settings of the potentiometers 90, 91 and 92. At these points, the threshold amplifiers 75, 76 and 77 commence in turn to contribute to the input current to the amplifier 107.

The result is that a curve relating the output of the amplifier 107 to the input $V_{IN}$, neglecting the amplifier 108, comprises five linear sections whose slopes are progressively decreasing. The break points at which the slope changes are selected by adjustment of the potentiometers 81, 90, 91 and 92.

Turning now to summing junction 88 and amplifier 108, it will be seen that the inputs to this junction comprise a fraction of the input $V_{IN}$ chosen by adjustment of the potentiometer 103 and fractions of the outputs of the threshold amplifiers 74, 75, 76 and 77 selected respectively by adjustment of the potentiometers 87, 96, 97 and 98. Consequently, the curve relating the output of amplifier 108 to the input $V_{IN}$ comprises five linear sections whose slopes are progressively less, and which individually are less than or equal to the slopes of the sections of the corresponding curve for the amplifier 107. The break points of the two curves are identical.

Since the output of the amplifier 108 is applied to the input terminal of the amplifier 107, the overall output of the latter amplifier is the difference between the two curves. Consequently, the overall characteristic is a curve comprising five linear sections, both the slopes of the individual sections and the break points at which the slopes change being adjustable. In addition, the DC level of the characteristic may be varied by adjustment of the "Shift" potentiometer 105, which modifies the current into the summing junction 88.

The Break-potentiometers, the Slope-potentiometers and the Shift-potentiometers are adjusted to produce an overall characteristic which matches within close limits a crane rating curve.

A law generator unit 73 is provided for each separate rating curve. Each first summing junction 85 is connected via its respective relay contact RLIB to the input terminal of the amplifier 107, and each second summing junction 88 is connected via its respective relay contact RLIC to the input terminal of the amplifier 108. Selection circuits within the mode unit 51 ensure that only one of the relays, such as relay RLI, is energized at any one time, so that only one of the law generator units 73 is operational.

The selection circuits are arranged to energized the particular law generator unit appropriate to the mode of operation in which the crane is being used and may be automatic in operation. For example, sensors may be provided to detect when the outrigger booms are extended and blocked up. Only when the outrigger sensors are operated will a law generator for blocked modes of operation be brought into circuit. If the sensors are not operated, a law generator appropriate to free-on-wheel modes of operation will be selected.

Similarly, for cranes whose fly jib duty ratings are overridden by the main radius duty ratings for certain combinations of luff angle and boom extension, the boom extension and luff angle will be supplied to the selector circuits and the law generator unit selected will depend on the values of these signals.

The true radius output TR provided by the amplifier 66 (FIG. 2) is supplied to the mode unit 51 and is connected to the inputs of those law generator units 73 which are selected when the crane is performing radius-related modes of operation. Similarly, the luff angle output $\theta$ provided by the amplifier 33 is connected to the inputs of those law generator units which are selected for angle-related modes of operation. In each case, the connection is via the relay contact RLIA.

As previously mentioned with reference to FIG. 2, the effective length of the boom when fully retracted (output E), and also the values of the constant outputs F and K will vary for different modes of operation. In each of the law generator units 73 there is provided a preset variable resistor 40 having one end connected to the OV line and the other to one side of a relay contact RLIE. The other side of the contacts RLIE of all the units 73 are connected together and to the negative input terminal of amplifier 38 (FIG. 2) so as to connect the resistor 40 of the selected unit 73 in the position shown in the dotted rectangle containing resistor 40 of FIG. 2.

Similarly, each law generator unit 73 contains preset variable resistors 43 and 45 connectible via respective relay contacts RLIF and RLIG to the position shown for the dotted rectangles containing these resistors, respectively, in FIG. 2.

What we claim is:

1. A load indicating arrangement for use with a crane or other lifting apparatus having a pivotally mounted telescoping boom comprising, boom supporting means, means for producing a first output signal representative of the total turning moment of the boom about its pivot in supporting a load, said first output signal producing means including transducer means for producing an output signal which is a function of the reaction sustained by the boom supporting means in supporting the boom and any bad suspended therefrom and angle sensing means for modifying said output signal in accordance with the sine of the angle included between the boom supporting means and the boom, means for producing a second output signal representative of the turning moment of the boom about its pivot due to the weight of the boom alone, means for combining said first and second output signals to produce a third output signal which is the algebraic difference between said first and second output signals and which is thus representative of the turning moment due only to the load, means for deriving a load radius output signal representative of the horizontal distance between the boom pivot point and the load and independent of the weight of the boom, a law generator unit for each mode of operation of the crane, a first one of the law generator units including means responsive to said load radius output signal for producing a fourth output signal which varies with the load radius and is representative of the maximum safe load moment for the crane in the appertaining mode of operation involving radius related duties and for the existing load radius, and means for comparing said fourth output signal with said third output signal to provide an indication of available lifting capacity.

2. A load indicating arrangement for use with a crane or other lifting apparatus having a pivotally mounted telescoping boom comprising, means for producing a first output signal representative of the total turning moment of the boom about its pivot in supporting a load, means for producing a second output signal representative of the turning moment of the boom about its pivot due to the weight of the boom alone, means for combining said first and second output signals to produce a third output signal which is the algebraic difference between said first and second output signals and which is thus representative of the turning moment due only to the load, a law generator unit for each mode of operation of the crane, a first one of the law generator units including means for producing a fourth output signal which varies with the load radius and is representative of the maximum safe load moment for the crane in the appertaining mode of operation and for the existing load radius, means for comparing said fourth output signal with said third output signal to provide an indication of available capacity, a second one of said law generator units for angle related duties including means for producing a further fourth output signal which in this case is representative of the maximum safe hook load for the crane in the appertaining angle related mode of operation and for the existing luff angle, means for producing a fifth output signal which is representative of the weight of the load, and means for comparing said fifth output signal with said further fourth output signal to provide an indication of the actual crane hook load relative to the maximum safe hook load.

3. An arrangement as claimed in claim 2 wherein the second output signal producing means comprises, means for producing a sixth output signal which is representative of the horizontal distance between the boom pivot point and the load, means for producing a seventh output signal which is representative of the weight of the boom structure acting through its center of gravity, and means for multiplying said sixth and seventh output signals.

4. An arrangement as claimed in claim 3, wherein the means for producing said fifth output signal includes means for dividing said third output signal by said sixth output signal.

5. An arrangement as claimed in claim 3 wherein the means for producing said sixth output signal comprises, means for producing an eighth output signal which is representative of the length of the boom, means for producing a ninth output signal which is representative of the cosine of the boom luff angle, and means for multiplying said eighth and ninth output signals to derive said sixth output signal.

6. An arrangement as claimed in claim 5, including means for modifying the value of said second output signal as a function of boom deflection.

7. An arrangement as claimed in claim 6 wherein the boom is fitted with a fly jib, said arrangement including means for producing a tenth output signal which is representative of the turning moment due to the fly jib, and means for summing the tenth output signal with said second output signal to produce a resultant output signal representative of the true boom moment with a fly jib.

8. An arrangement as claimed in claim 7, including means for producing an eleventh output signal which is representative of the total horizontal distance between the boom pivot point and the load with the latter suspended from the fly jib, and means for modifying the value of said eleventh output signal by a factor which is representative of the weight of the fly jib acting through its center of gravity thereby to derive the tenth output signal.

9. An arrangement as claimed in claim 8, including means for producing a twelfth output signal which is representative of the length of the fly jib, means for producing a thirteenth output signal which is representative of the cosine of the difference between the boom luff angle and the offset angle of the fly jib, means for multiplying said twelfth and thirteenth output signals to derive a fourteenth output signal which is representative of the horizontal distance of the fly jib, and means for summing the fourteenth output signal with said sixth output signal to produce said eleventh output signal.

10. An arrangement as claimed in claim 8 including means for producing a fifteenth output signal which is representative of boom deflection, and means for summing the fifteenth output signal with the sum of said sixth and eleventh output signals to produce a resultant output signal representative of the true horizontal distance between the boom pivot point and the load.

11. An arrangement as claimed in claim 10, including means for producing a sixteenth output signal which is representative of the product of the boom luff angle and the total boom length currently obtaining, and means for taking the product of said first output signal and said sixteenth output signal to derive said fifteenth output signal.

12. An arrangement as claimed in claim 2 further comprising means for deriving an output signal representative of the boom luff angle, and wherein for modes of operation involving angle related duties the second law generator unit is responsive to the bottom luff angle output signal.

13. An arrangement as claimed in claim 12 further comprising means for deriving a load radius output signal representative of the horizontal distance between the boom pivot point and the load and wherein for modes of operation involving radius related duties the first law generator unit is responsive to said load radius output signal, and further comprising switch means for selecting one or the other of said output signals to which a selected law generator unit is to be responsive.

14. A load indicating system for a crane having a pivoted boom comprising, means for producing a first output signal representing the total turning moment of the boom and its load about the boom pivot, means for producing second and third output signals representing the length of the boom and the boom luff angle, respectively, means responsive to said second and third output signals for producing a fourth output signal representing the horizontal distance between the load and the boom pivot point, means responsive to the second output signal for producing a fifth output signal representing the weight of the boom alone acting through its center of gravity, law generator means for selectively producing an output signal representing the maximum safe load moment of the crane or the maximum safe hook load for the existing mode of crane operation, and computing means responsive to said first, second, third, fourth, fifth and law generator output signals for deriving output indicating signals representing the available crane lifting capacity and the weight of the load.

15. A load indicating system as claimed in claim 14 further comprising means responsive to said first, second and third output signals for deriving a sixth signal representing boom deflection under load, said sixth output signal deriving means comprising, a first multiplier unit responsive to the second and third output signals to produce a seventh output signal, and a second multiplier unit reponsive to the first and seventh output signals to produce said sixth output signal, and means for combining said fourth and sixth output signals to produce an eighth signal representing the corrected horizontal distance between the load and the boom pivot point.

16. A load indicating system as claim in claim 14 wherein the means for producing said fifth output signal comprises, a differential amplifier with a first input coupled to receive the second output signal and a second input responsive to an adjustable source of voltage representing a boom constant, a source of fixed reference voltage representing the weight of the boom, and means for combining the differential amplifier output signal with the fixed reference voltage to derive said fifth output signal.

17. A load indicating system as claimed in claim 14 further comprising means responsive to said first, second and third output signals for deriving a sixth signal representing boom deflection under load, means for combining said fourth and sixth output signals to produce a true radius signal representing the corrected horizontal distance between the load and the boom pivot point, and wherein said computing means comprises a multiplier unit responsive to said fifth output signal and said true radius signal for producing a signal representing the turning moment of the unloaded boom.

18. A load indicating system as claimed in claim 14 further comprising switching means for selectively connecting the input of the law generator means to receive the fourth output signal and the third output signal for radius related duties and angle related duties, respectively.

19. A load indicating system as claimed in claim 14 wherein said computing means comprises a multiplier unit responsive to said fourth and fifth output signals to produce a signal representing the turning moment of the boom alone, means for combining said first output signal with the signal representing the boom turning moment to derive a sixth output signal representing the turning moment of the load alone, and means for comparing the sixth output signal with the output signal of the law generator means in the relevant mode of crane operation to derive said output indicating signal representing the available crane lifting capacity.

20. A load indicating system as claimed in claim 14 wherein the boom is fitted with a fly jib and said computing means comprises, means for deriving a signal representing the fly jib offset angle$\alpha$, a cosine law generator unit responsive to said offset angle signal and said third output signal to derive a signal representing the cosine of the angle $\theta-\beta$ where $\theta$ represents the boom luff angle, means for producing a sixth signal representing the length of the fly jib, a multiplier unit responsive to the sixth signal and the output signal of the cosine law generator unit to produce a seventh output signal, and means for summing said fourth output signal with said seventh output signal to derive a signal representing true load radius of the boom and fly jib structure.

* * * * *

UNITED STATES PATENT AND TRADEMARK OFFICE

CERTIFICATE OF CORRECTION

PATENT NO. : 3,965,733

DATED : June 29, 1976

INVENTOR(S) : BERNARD D. F. HUTCHINGS ET AL

It is certified that error appears in the above-identified patent and that said Letters Patent are hereby corrected as shown below:

In the title: change "INIDICATING" to -- INDICATING --;

Claim 1, line 10, cancel "bad" and insert -- load --;

Claim 20, line 4, cancel "α" and insert -- β --;

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*